US005154210A

United States Patent [19]

Scruggs

[11] Patent Number: 5,154,210

[45] Date of Patent: Oct. 13, 1992

[54] ROLLOVER TOOL FOR ENDS OF METAL BANDS

[75] Inventor: Michael G. Scruggs, Orlando, Fla.

[73] Assignee: Daniels Manufacturing Company, Orlando, Fla.

[21] Appl. No.: 730,044

[22] Filed: Jul. 15, 1991

[51] Int. Cl.[5] ..... B21F 15/00

[52] U.S. Cl. ..... 140/150; 72/410

[58] Field of Search ..... 140/93 D, 93.4, 150; 72/409, 410

[56] References Cited

U.S. PATENT DOCUMENTS

| | | | |
|---|---|---|---|
| 2,440,040 | 4/1948 | Burton | 140/93 D |
| 2,942,269 | 6/1960 | Austin | 72/410 |
| 4,696,327 | 9/1987 | Wolcott | 140/150 |

OTHER PUBLICATIONS

Daniels Manufacturing Corporation; "DBS-R01 Rollover Tool"; 1990; pp. 1-2.

*Primary Examiner*—Lowell A. Larson

*Attorney, Agent, or Firm*—James H. Beusse

[57] ABSTRACT

A crimping or rollover tool for an end of a metal band used to secure a metal braid to an electrical conductor is formed in a plier-like tool having a guide for accurately locating the tool and a pivotable crimping element operable to effect crimping of the band end without loosening of the band. The guide is slidingly coupled to a jaw of the tool with the crimping element pinned to the guide. Closing of the tool jaws causes rotation of the crimping element to bend the band end over a band buckle without pushing the band end backwards through the buckle.

4 Claims, 2 Drawing Sheets

ROLLOVER TOOL FOR ENDS OF METAL BANDS

The present invention relates to banding apparatus for attaching metal bands about an object and, more particularly, to an apparatus for crimping an end of such bands to prevent loosening.

BACKGROUND OF THE INVENTION

Application Ser. No. 07/681,557 filed Apr. 5, 1991, and assigned to the assignee of the present invention discloses a banding tool for tightening and restraining a metal band, such as that shown in U.S. Pat. No. 4,751,769, about a termination sleeve, i.e., about a woven metal braid portion of an electrical cable about a tubular sleeve portion of an electrical connector. The tool provides band tension sufficient to assure good electrical connection between the braid portion and the termination sleeve. Once the band has been tightened about the sleeve, the end passing through the tool is bent and then cut off. Thereafter, it is necessary to further crimp or flatten the bent end to prevent the band from loosening.

Metal bands of the type shown in the aforementioned U.S. Pat. No. 4,751,769 are formed with a buckle on one end. The buckle is a closed loop through which the other end of the band is inserted. The band is formed of generally rigid stainless steel so that bending the other end at an acute angle over the buckle is sufficient to prevent a tightened band from loosening. Various methods have been employed to bend the band end over the buckle, including general purpose pliers and specially adapted devices for gripping the buckle. However, these devices have not been fully successful in always providing a satisfactorily crimp position of the band end.

SUMMARY OF THE INVENTION

The above and other disadvantages of the prior art are overcome in a band crimping tool which smoothly bends a band end over a buckle in a manner to generally inhibit any release of tension in the band and provide a successful crimp. In one form, the crimping tool comprises a generally plier-like apparatus having a pair of handles and a pair of opposed jaws. One of the jaws includes a movable guide attached to the jaw in a manner to move only in a direction parallel to the direction of closing of the jaws. The guide includes a slot for receiving a buckle of a band. A pivotable crimping member is coupled to the guide and positioned to pivot over the slot when the jaws are closed. The crimping member is shaped to contact an end of a band extending from the buckle and to bend the band end downwardly and reversely over the buckle. Springs are provided to return the guide and crimping member to a rest position when the jaws are opened.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
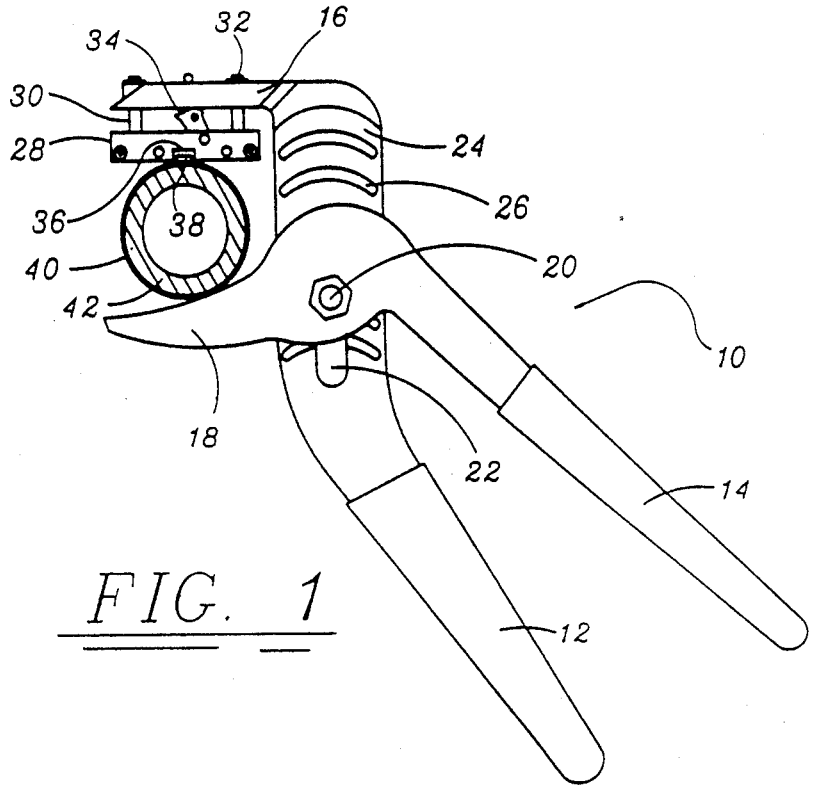
FIG. 1 illustrates one form of a crimping tool in accordance with the present invention preparatory to effecting a crimping step.
Figure 2:
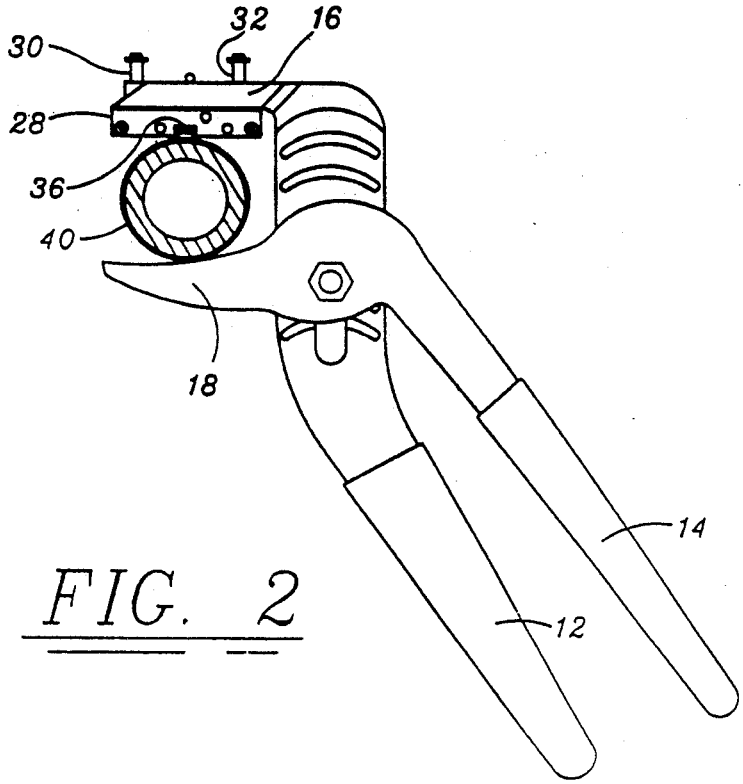
FIG. 2 illustrates the tool of FIG. upon completion of crimping.

Referring to FIGS. 1–4 generally and to FIGS. 1 and 2 in particular, there is shown a pair of pliers 10 of the type sometimes referred to as channel-lock pliers having a pair of handles 12 and 14 for effecting opening and closing of a pair of jaws 16 and 18. The pliers 10 have a pivot pin 20 movable in a slot 22 which allows the jaw spacing to be selectably adjustable. Alternate channels 24 and ridges 26 in opposing faces of each of the handles 12 and 14 are interlocked at different selected positions to effect the selective spacing of the jaws. A guide member 28 is coupled in sliding engagement with jaw 16 by means of a pair of pins 30, 32 positioned at opposite ends of jaw 16. A pivotable crimping member 34 is coupled to guide member 28 and positioned to be urged into counterclockwise (CCW) rotation as jaw 16 approaches guide member 28. Guide member 28 includes a generally centrally located slot 36 adapted to fit over a buckle 38 of a band 40 placed around an electrical connector 42. When the handles 12 and 14 are squeezed to move the jaws 16 and 18 from their generally open position in FIG. 1 to their closed position in FIG. 2, the desired degree of crimping occurs when guide member 28 is in an abutting position with jaw 16 as shown in FIG. 2.

Figure 3:
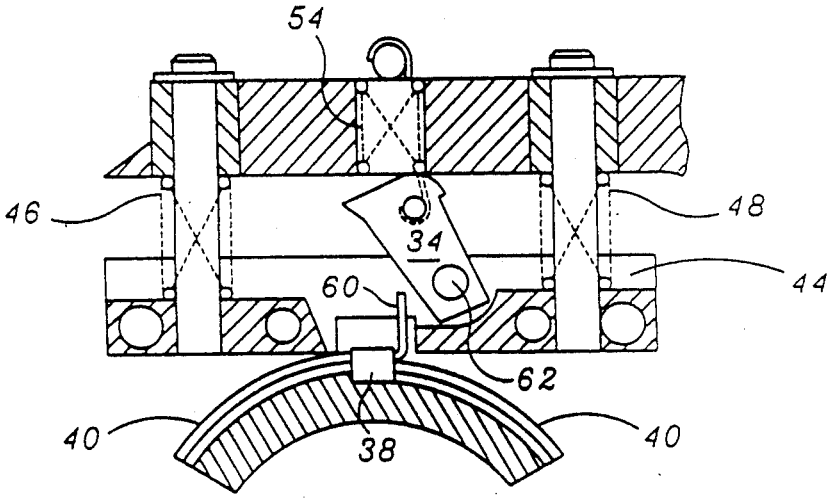
FIGS. 3 and 4 are enlarged views of the crimping mechanism of FIGS. 1 and 2 in their respective positions.
Figure 4:
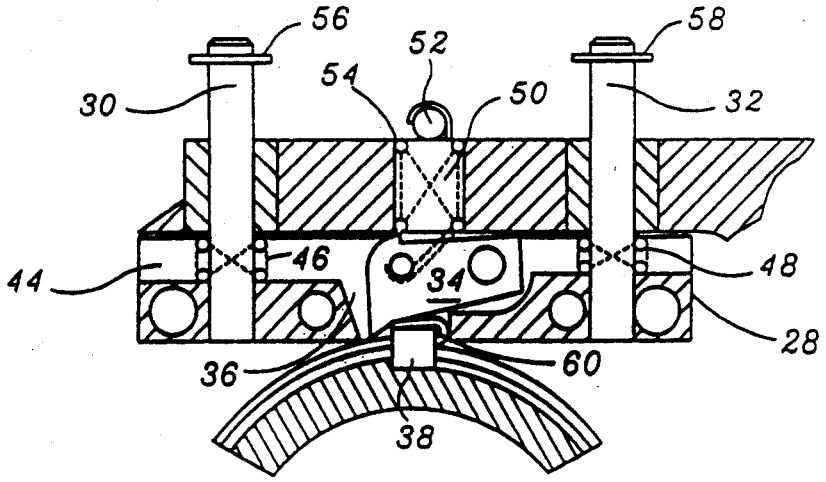

FIGS. 3 and 4 are cross-sectional views of the guide member 28, crimping member 34, and their respective connections to jaw 16. Guide member 28 is formed with a lengthwise slot 44 for receiving the crimping member 34 and a pair of compression springs 46, 48. The springs 46, 48 are positioned about respective ones of the pins 30, 32 and function to force guide member 28 away from jaw 16 and to generally hold guide member 28 steady with respect to jaw 16 to facilitate positioning of the member 28 on a band buckle. A tension spring 50 is coupled between crimping member 34 and a spring retainer 52 at an outer surface of jaw 16. An aperture 54 is formed in jaw 16 for receiving the spring 50. Snap rings 56, 58 on each of the pins 30, 32, respectively, retain the pins in the assembly against the compression springs 46, 48.

The crimping member 34 is shaped and positioned so as to urge the end 60 of band 40 to bend arcuately about the buckle 38. The member 34 pivots about pin 62 immediately forward of the buckle 38 when the tool is in an operative position. As shown in FIG. 4, a distal end of member 34 is directed downwardly when the jaws 16, 18 are in their closed position. During closing of the jaws, the crimping member 34 continuously urges the band end 60 to rotate counterclockwise so as to crimp the band end without tending to urge the band end backwards through the buckle 38 and loosening the band. The top surface of the crimping member 34 is arcuately shaped to slide on inner surface 64 of jaw 16 as the tool 10 is operated.

Although the tool 10 has been shown as having a jaw 16 with apertures drilled or otherwise formed therethrough for receiving the pins 30, 32 and spring 50, it will be apparent that a separate member could be attached to a side of jaw 16 for supporting guide member 28.

While the invention has been described in what is presently considered to be a preferred embodiment, various modifications and arrangements will become apparent to those skilled in the art. It is intended, therefore, that the invention not be limited to the illustrative embodiment but be interpreted within the full spirit and scope of the appended claims.

What is claimed is:

1. A crimping tool for crimping an end of a metal band securing an electrical conductor shield to an electrical connector, the band end being crimped about a buckle through which the band is threaded, the tool comprising:

a generally plier-like apparatus having first and second opposed handles and first and second opposed jaws, opening an closing of said handles one towards the other being effective to cause a corresponding opening and closing of the jaws;

guide means reciprocally mounted to one of the jaws for guiding said apparatus into a predetermined position with respect to a band to be crimped, said guide means being reciprocally moveable generally perpendicular to said one of the jaws and including a slot for receiving the buckle and the end of a band to be crimped; and pivotable crimping means coupled to said guide means and positioned between said guide means and said one of the jaws adjacent said slot, said one of the jaws engaging said crimping means and being operable upon closing of the jaws to pivot said crimping means in a direction to effect a crimping of the band end over the buckle.

2. The crimping tool of claim 1 and including compression spring means for generally urging said guide means from said one of the jaws.

3. The crimping tool of claim 2 and including tension spring means for returning said crimping means to a preselected position upon opening of said jaws.

4. The crimping tool of claim 1 wherein said crimping means is coupled to pivot point on said guide means displaced perpendicularly from a tangent line intersecting the band at the buckle, said crimping means having a distal end rotating below said pivot point when said jaws are in a closed position for urging said band end downwardly with respect to the tangent line.

* * * * *